US011742168B2

(12) United States Patent
Huang et al.

(10) Patent No.: US 11,742,168 B2
(45) Date of Patent: Aug. 29, 2023

(54) OPERATING MECHANISM OF CIRCUIT BREAKER

(71) Applicant: HANGZHOU TAIMU ELECTRICAL CO., LTD., Hangzhou (CN)

(72) Inventors: Xieyun Huang, Hangzhou (CN); Wen Zhou, Hangzhou (CN); Qiang Zhang, Hangzhou (CN)

(73) Assignee: HANGZHOU TAIMU ELECTRICAL CO., LTD., Hangzhou (CN)

( * ) Notice: Subject to any disclaimer, the term of this patent is extended or adjusted under 35 U.S.C. 154(b) by 0 days.

(21) Appl. No.: 17/881,641

(22) Filed: Aug. 5, 2022

(65) Prior Publication Data

US 2023/0041691 A1 Feb. 9, 2023

(30) Foreign Application Priority Data

Aug. 5, 2021 (CN) ..... 202110899730.X

(51) Int. Cl.
*H01H 71/10* (2006.01)
*H01H 71/12* (2006.01)
*H01H 71/24* (2006.01)

(52) U.S. Cl.
CPC ..... *H01H 71/128* (2013.01); *H01H 71/10* (2013.01); *H01H 71/2472* (2013.01)

(58) Field of Classification Search
CPC ..... H01H 71/10
See application file for complete search history.

(56) References Cited

FOREIGN PATENT DOCUMENTS

CN 209266338 U * 8/2019 ..... H01H 71/10
CN 212257313 U * 12/2020

* cited by examiner

*Primary Examiner* — Ramon M Barrera
(74) *Attorney, Agent, or Firm* — Bayramoglu Law Offices LLC

(57) ABSTRACT

An operating mechanism of a circuit breaker includes a moving contact bracket, a moving contact assembly, and a reset torsion spring. The moving contact bracket is provided with a rotating shaft, and the moving contact bracket may be rotated around the rotating shaft; a first end of the reset torsion spring is arranged on a base of the circuit breaker, and a second end of the reset torsion spring is arranged on the moving contact assembly; the moving contact assembly is rotatably arranged on the moving contact bracket, and the moving contact bracket is provided with a limiting portion, so that in a closing process of the circuit breaker, the moving contact assembly is pressed against the limiting portion and rotated synchronously with the moving contact bracket, and the reset torsion spring applies a force rotated towards a disconnection direction of the circuit breaker to the moving contact bracket.

20 Claims, 2 Drawing Sheets

OPERATING MECHANISM OF CIRCUIT BREAKER

CROSS REFERENCE TO THE RELATED APPLICATIONS

This application is based upon and claims priority to Chinese Patent Application No. 202110899730.X, filed on Aug. 5, 2021, the entire contents of which are incorporated herein by reference.

TECHNICAL FIELD

The present application relates to the technical field of circuit breakers, and in particular, to an operating mechanism of a circuit breaker.

BACKGROUND

A circuit breaker refers to a switching device that can close, load and break current under a normal loop condition, and may close, load and break the current under an abnormal loop condition within a specified time. The circuit breaker may be used to distribute electrical energy, start an asynchronous motor infrequently, and protect a power line and a motor and the like. They may cut off a circuit while serious failures such as overload or short-circuit and under-voltage happen, a function thereof is equivalent to a combination of a fuse-type switch and a overheating and underheating relay and the like. Moreover, it is generally not necessary to change parts after breaking a failure current.

The breaking of the circuit breaker is achieved by the action of an operating structure. At present, a common circuit breaker operating mechanism is mostly composed of parts such as a handle, a locking catch, a jump pin, a moving contact bracket and a moving contact assembly, herein the moving contact bracket and the moving contact assembly use one reset spring respectively, so that the structure is complicated relatively, and the production cost and assembly time are increased.

In allusion to a problem in a related technology that the moving contact bracket and the moving contact assembly in the operating mechanism use one reset spring respectively, so that the structure is complicated relatively, and the production cost and assembly time are increased, an effective scheme is not proposed yet at present.

SUMMARY

A main purpose of the present application is to provide an operating mechanism of a circuit breaker, as to solve a problem in a related technology that a moving contact bracket and a moving contact assembly in the operating mechanism use one reset spring respectively, so that the structure is complicated relatively, and the production cost and assembly time are increased.

In order to achieve the above purpose, the present application provides an operating mechanism of a circuit breaker. The operating mechanism of the circuit breaker includes a moving contact bracket, a moving contact assembly, and a reset torsion spring.

Herein, the moving contact bracket is provided with a rotating shaft, and the moving contact bracket may be rotated around the rotating shaft.

A first end of the reset torsion spring is arranged on a base of the circuit breaker, and a second end of the reset torsion spring is arranged on the moving contact assembly.

The moving contact assembly is rotatably arranged on the moving contact bracket, and the moving contact bracket is provided with a limiting portion, so that in a closing process of the circuit breaker, the moving contact assembly is pressed against the limiting portion and rotated synchronously with the moving contact bracket, and the reset torsion spring applies a force rotated towards a disconnection direction of the circuit breaker to the moving contact bracket.

While the circuit breaker is closed, the moving contact assembly and the moving contact bracket are rotated relatively, and the reset torsion spring applies a contact pressure to the moving contact assembly.

Further, the moving contact assembly includes a contact connector and a moving contact arranged on a lower end of the contact connector, and the contact connector is rotatably arranged on the moving contact bracket; and the second end of the reset torsion spring is arranged on the contact connector, and located above a rotation axis of the contact connector.

Further, the moving contact bracket is provided with a contact installing groove, the contact installing groove is provided with a rotating lug boss, the contact connector is arranged in the contact installing groove, the contact connector is provided with a slot, and the slot is locked on the rotating lug boss, so that the contact connector may be rotated around an axis of the rotating lug boss.

The limiting portion is a limiting lug boss arranged on the contact installing groove, and the contact connector is pressed against the limiting lug boss.

Further, the moving contact bracket is provided with an annular installing groove, the annular installing groove is arranged coaxially with the rotating shaft, and the reset torsion spring is installed in the annular installing groove.

Further, the moving contact bracket is provided with an upper limiting groove and a lower limiting groove communicated with the annular installing groove, and the first end and the second end of the reset torsion spring are respectively extended into the upper limiting groove and the lower limiting groove.

Further, an upper end of the contact connector is provided with a catching groove, and the second end of the reset torsion spring is arranged in the catching groove. The diameter of the catching groove is greater than the diameter of the second end of the reset torsion spring.

Further, a handle and a handle connecting rod are included, the moving contact bracket is provided with a bracket groove, a first end of the handle connecting rod is connected with the handle, and a second end is placed in the bracket groove.

While the handle connecting rod is slid in the bracket groove, the moving contact bracket may be driven to rotate so as to drive the moving contact assembly to operate.

Further, a locking catch arranged on a side surface of the moving contact bracket is further included, the locking catch is provided with a locking catch groove, the second end of the handle connecting rod is placed in the locking catch groove and the bracket groove, and while the handle connecting rod is slid in the bracket groove and the locking catch groove, the moving contact bracket and the locking catch may be driven to rotate.

Further, the locking catch is sheathed on the rotating shaft, and the locking catch is connected with the moving contact bracket by a locking catch torsion spring.

A lower end of the locking catch is provided with a bimetal pull rod, and one end, away from the locking catch, of the bimetal pull rod is used to interfere with a bimetal strip of the circuit breaker.

Further, the lower end of the locking catch is provided with a fixing groove, and an end portion of the bimetal pull rod is fixed in the fixing groove.

In the embodiment of the present application, the moving contact bracket, the moving contact assembly and the reset torsion spring are arranged; herein, the moving contact bracket is provided with the rotating shaft, and the moving contact bracket may be rotated around the rotating shaft; the first end of the reset torsion spring is arranged on the base of the circuit breaker, and the second end of the reset torsion spring is arranged on the moving contact assembly; the moving contact assembly is rotatably arranged on the moving contact bracket, and the moving contact bracket is provided with the limiting portion, so that in the closing process of the circuit breaker, the moving contact assembly is pressed against the limiting portion and rotated synchronously with the moving contact bracket, and the reset torsion spring applies the force rotated towards the disconnection direction of the circuit breaker to the moving contact bracket; while the circuit breaker is closed, the moving contact assembly and the moving contact bracket are rotated relatively, and the reset torsion spring applies the contact pressure to the moving contact assembly, as to achieve a purpose of using one torsion spring to apply the force towards the disconnection direction of the circuit breaker and the contact pressure to the moving contact bracket and the moving contact assembly respectively, thereby the technical effects of simplifying the structure of the operating mechanism, and reducing the production cost and assembly time are achieved, and the problem that the moving contact bracket and the moving contact assembly of the operating mechanism in the related technology use one reset spring respectively, so that the structure is complicated relatively, and the production cost and assembly time are increased is solved.

BRIEF DESCRIPTION OF THE DRAWINGS

Drawings for constituting a part of the present application are used to provide further understanding of the present application, so that other features, purposes, and advantages of the present application become more apparent. The schematic embodiment drawings of the present application and descriptions thereof are used to explain the present application, and do not constitute improper limitation to the present application. In the drawings.

Figure 1:
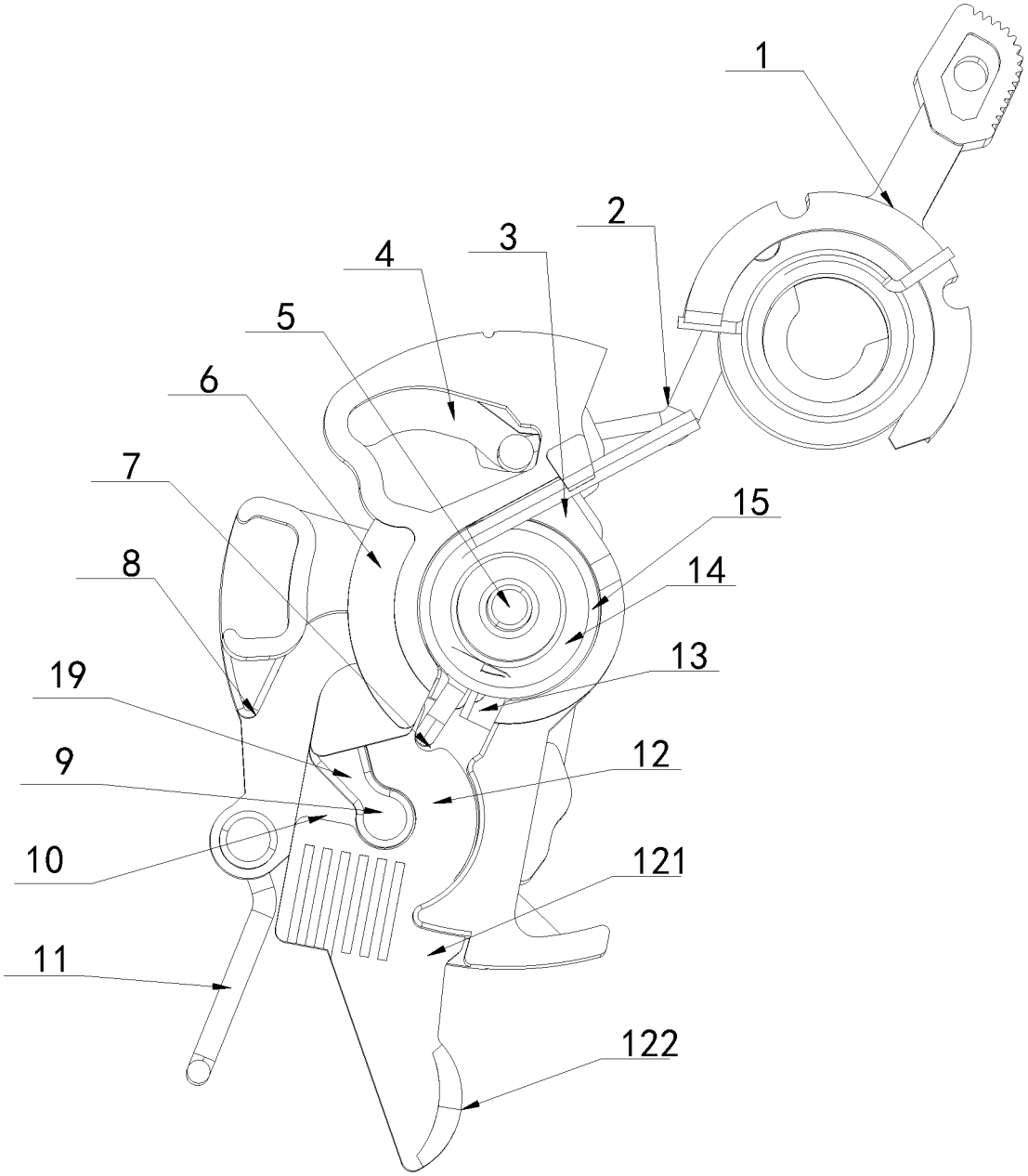
FIG. 1 is a front view structure schematic diagram according to an embodiment of the present application.

Herein, 1 Handle, 2 Handle connecting rod, 3 Upper limiting groove, 4 Bracket groove, 5 Rotating shaft, 6 Moving contact bracket, 7 Catching groove, 8 Locking catch, 9 Rotating lug boss, 10 Contact installing groove, 11 Bimetal pull rod, 12 Moving contact assembly, 121 Contact connector, 122 Moving contact, 13 Lower limiting groove, 14 Reset torsion spring, 15 Annular installing groove, 16 Locking catch groove, 17 Fixing groove, 18 Locking catch torsion spring, and 19 Limiting portion.

DETAILED DESCRIPTION OF THE EMBODIMENTS

To make the solutions of the present application clearer to those skilled in the art, the technical solutions in embodiments of the present application will be clearly and completely described below with reference to the drawings in the embodiments of the present application. Apparently, the described embodiments are only a part of the embodiments of the present application and not all the embodiments. Based on the embodiments in the present application, all other embodiments obtained by those skilled in the art without involving any inventive effort shall fall within the protection scope of the present application.

It should be noted that terms "first" and "second" and the like in the description and claims of the present application and the above drawings are used to distinguish similar objects, and are not necessarily used to describe a specific sequence or a precedence order. It should be understood that data used in this way may be interchanged under appropriate circumstances for the purposes of the embodiments of the present application described herein.

In the present application, orientations or positional relationships indicated by terms "upper", "lower", "inner" and the like are based on the orientations or positional relationships shown in the drawings. These terms are mainly used to better describe the present application and the embodiments thereof, and are not used to limit that the indicated device, element, or component must have a specific orientation, or be constructed and operated in the specific orientation.

Moreover, some of the above terms, in addition to being used to indicate the orientation or positional relationship, may also be used to indicate other meanings, for example, the term "upper" may also be used to indicate an attachment or connection relationship in some situations. The specific meaning of those terms in the present application may be understood by those of ordinary skill in the art according to specific situations.

In addition, terms "set", "provide", "connect", "fix" and the like should be understood in a broad sense. For example, the "connect" may be a fixed connection, a detachable connection, or an integral structure; it may be a mechanical connection or an electrical connection; it may be a direct connection, or an indirect connection through an intermediation, or internal communication between two devices, elements or constituent parts. For those of ordinary skill in the art, the specific meanings of the above terms in the present application may be understood according to the specific circumstances.

In addition, the term "a plurality of" should have the meaning of two or more.

It is to be noted that the embodiments in the present application and the features in the embodiments may be combined with one another without conflict. The present application will now be described below in detail with reference to the drawings and the embodiments.

Figure 2:
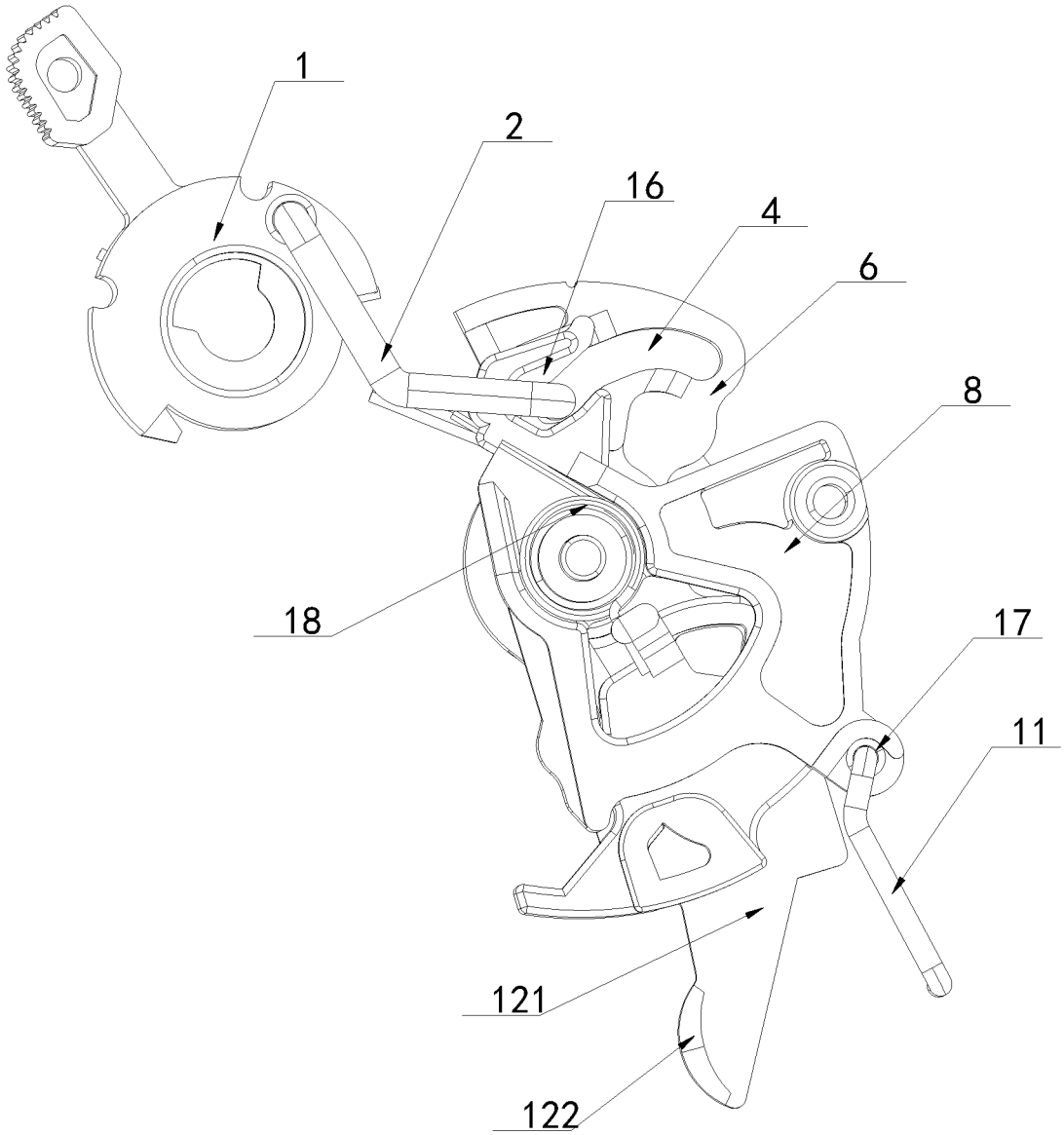
FIG. 2 is a rear view structure schematic diagram according to an embodiment of the present application.

As shown in FIG. 1 to FIG. 2, the embodiment of the present application provides an operating mechanism of a circuit breaker, the operating mechanism of the circuit breaker includes: a moving contact bracket 6, a moving contact assembly 12, and a reset torsion spring 14.

Herein, the moving contact bracket 6 is provided with a rotating shaft 5, and the moving contact bracket 6 may be rotated around the rotating shaft 5.

A first end of the reset torsion spring 14 is arranged on a base of the circuit breaker, and a second end of the reset torsion spring 14 is arranged on the moving contact assembly 12.

The moving contact assembly 12 is rotatably arranged on the moving contact bracket 6, and the moving contact bracket 6 is provided with a limiting portion 19, so that in a closing process of the circuit breaker, the moving contact assembly 12 is pressed against the limiting portion 19 and rotated synchronously with the moving contact bracket 6, and the reset torsion spring 14 applies a force rotated towards a disconnection direction of the circuit breaker to the moving contact bracket 6.

While the circuit breaker is closed, the moving contact assembly 12 and the moving contact bracket 6 are rotated relatively, and the reset torsion spring 14 applies a contact pressure to the moving contact assembly 12.

In this embodiment, the moving contact bracket 6 is connected with a handle 1, and the moving contact bracket 6 is driven by the handle 1 to operate, thereby the moving contact assembly 12 installed on the moving contact bracket 6 is driven to operate, so that the moving contact assembly 12 contacts with a static contact assembly in the circuit breaker, as to achieve the turn-on. A movement mode of the moving contact bracket 6 in the operating mechanism is rotational movement. Since the moving contact bracket 6 is provided with the rotating shaft 5 and rotatably connected with the rotating shaft 5, the rotating shaft 5 may be fixed in the circuit breaker, so that the moving contact bracket 6 may be rotated around the axis of the rotating shaft 5.

While the moving contact bracket 6 is installed on the base of the circuit breaker, the moving contact bracket 6 and the base are connected by the rotating shaft 5, so that the moving contact bracket 6 may be rotated around the axis of the rotating shaft 5. Because the first end of the reset torsion spring 14 is connected with the base, while the moving contact bracket 6 is rotated (counterclockwise rotated) towards the closing direction of the circuit breaker, the first end of the reset torsion spring 14 is fixed in position under the limitation of the base.

Since the second end of the reset torsion spring 14 is connected with the moving contact assembly 12, and the moving contact assembly 12 is installed on the moving contact bracket 6 and pressed against the limiting portion 19 on the moving contact bracket 6, in a process that the moving contact bracket 6 is counterclockwise rotated, the moving contact bracket 6 and the moving contact assembly 12 are rotated synchronously, so that the second end of the reset torsion spring 14 applies the force rotated towards the disconnection direction of the circuit breaker to the moving contact bracket 6; and while the moving contact assembly 12 contacts with the static contact in the circuit breaker and the pressure is applied, the moving contact assembly 12 may be clockwise rotated relative to the moving contact bracket 6 under a reaction force of the static contact, because the second end of the reset torsion spring 14 is connected with the moving contact assembly 12, in a process that the moving contact assembly 12 is clockwise rotated relative to the moving contact bracket 6, the second end of the reset torsion spring 14 applies a reaction force rotated counterclockwise, namely the contact pressure, to the moving contact assembly 12, so that the moving contact assembly 12 is tightly pressed against the static contact assembly.

Compared with the structure in the related technology in which the reset of the moving contact bracket 6 is achieved by a torsion spring or spring, and an overtravel action force of the moving contact assembly 12 is achieved by another torsion spring or spring, this embodiment adopts one reset torsion spring 14 to achieve the reset of the moving contact bracket 6 and the connection between the moving contact assembly 12 and the static contact assembly. From a structural point of view, the structure of the operating mechanism is simpler and more compact, thereby the technical effects of simplifying the structure of the operating mechanism, and reducing the production cost and assembly time are achieved, and the problem that the moving contact bracket and the moving contact assembly 12 of the operating mechanism in the related technology use one reset spring respectively, so that the structure is complicated relatively, and the production cost and assembly time are increased is solved.

As shown in FIG. 1 to FIG. 2, the moving contact assembly 12 includes a contact connector 121 and a moving contact 122 arranged on a lower end of the contact connector 121, the contact connector 121 is rotatably arranged on the moving contact bracket 6, and located above a rotation axis of the contact connector 121.

Specifically, it should be noted that the moving contact assembly 12 is mainly composed of the contact connector 121 and the moving contact 122, herein the moving contact 122 is used to interfere with the static contact in the circuit breaker, and the contact connector 121 is used to connect with the second end of the reset torsion spring 14. While closed, the second end of the reset torsion spring 14 applies a force pressed against the static contact in the circuit breaker to the moving contact assembly 12.

As shown in FIG. 1 to FIG. 2, the moving contact bracket 6 is provided with a contact installing groove 10, the contact installing groove 10 is provided with a rotating lug boss 9, the contact connector 121 is arranged in the contact installing groove 10, the contact connector 121 is provided with a slot, and the slot is locked on the rotating lug boss 9, so that the contact connector 121 may be rotated around an axis of the rotating lug boss 9.

The limiting portion 19 is a limiting lug boss arranged on the contact installing groove 10, and the contact connector 121 is pressed against the limiting lug boss.

Specifically, it should be noted that the rotating lug boss 9 is a convex structure arranged on the moving contact bracket 6, and the main structure thereof is cylindrical. The slot provided on the contact connector 121 is set as a round hole matched with the cylindrical convex structure, and the contact connector 121 cooperates with the rotating lug boss 9 through the slot so that the contact connector 121 may be rotated around the axis of the rotating lug boss 9 within a certain angle.

An upper end of the contact connector 121 is provided with a catching groove 7, and the second end of the reset torsion spring 14 is bended downwards and locked in the catching groove 7; and the diameter of the catching groove 7 is greater than the diameter of the second end of the reset torsion spring 14. The limiting lug boss is also a convex structure arranged on the moving contact bracket 6, and it may be strip-shaped. One side of the upper end of the contact connector 121 is connected with the second end of the reset torsion spring 14, and the other side is pressed against the limiting lug boss, the rotation of the contact connector 121 in the counterclockwise direction is limited by the limiting lug boss, so that in the closing process of the circuit breaker, the force applied to the contact connector 121 by the second end of the reset torsion spring 14 is transmitted to the moving contact bracket 6, and the force rotated towards the disconnection direction of the circuit breaker is obtained by the moving contact bracket 6.

As shown in FIG. 1 to FIG. 2, the moving contact bracket 6 is provided with an annular installing groove 15, the annular installing groove 15 is arranged coaxially with the rotating shaft 5, and the reset torsion spring 14 is installed in the annular installing groove 15.

Specifically, it should be noted that the moving contact bracket 6 is provided with a shaft hole, the rotating shaft 5 is installed in the shaft hole, the annular installing groove 15 is arranged on the periphery of the shaft hole, the annular installing groove 15, the shaft hole and the rotating shaft 5 are arranged on the same axis, and the reset torsion spring 14 may be locked in the annular installing groove 15, so that the structure of the moving contact bracket 6 is more compact.

As shown in FIG. 1 to FIG. 2, the moving contact bracket 6 is provided with an upper limiting groove 3 and a lower limiting groove 13 communicated with the annular installing groove 15, and the first end and the second end of the reset torsion spring 14 are respectively extend into the upper limiting groove 3 and the lower limiting groove 13.

Specifically, it should be noted that in an initial state, the first end of the reset torsion spring 14 is located in the upper limiting groove 3 and pressed against the limiting portion on the left side of the upper limiting groove 3, and the second end of the reset torsion spring 14 is located in the lower limiting groove 13 and connected with the moving contact assembly 12, in a closing state, due to the rotation of the moving contact bracket 6 and the moving contact assembly 12, the first end of the reset torsion spring 14 is located in the upper limiting groove 3 and pressed against the limiting portion on the right side of the upper limiting groove 3, and the second end of the reset torsion spring 14 is located in the lower limiting groove 13 and pressed against the left side of a place connected with the moving contact assembly 12.

While the moving contact 122 is just pressed against the static contact, the moving contact bracket 6 drives the contact connector 121 to be continuously rotated. Because the moving contact 122 installed on the contact connector 121 contacts with the static contact, the contact connector 121 may not be rotated synchronously with the moving contact bracket 6, so that under the rotating action force of the moving contact bracket 6, the contact connector 121 is clockwise rotated around the axis of the rotating lug boss 9, the left side of the slot is pressed against the second end of the reset torsion spring 14 and forces it to be deformed to obtain elastic potential energy, thereby the moving contact 122 is tightly pressed against the static contact in the circuit breaker.

As shown in FIG. 1 to FIG. 2, a handle 1 and a handle connecting rod 2 are included, the moving contact bracket 6 is provided with a bracket groove 4, a first end of the handle connecting rod 2 is connected with the handle 1, and a second end is placed in the bracket groove 4.

While the handle connecting rod 2 is slid in the bracket groove 4, the moving contact bracket 6 may be driven to rotate so as to drive the moving contact assembly 12 to operate.

Specifically, it should be noted that the handle 1 is fixedly installed in the circuit breaker base. Specifically, the handle 1 may be fixed by a spring, and the handle 1 may be rotated to a certain extent along an axis. The shape and structure of the handle 1 and a specific fixing mode may be set according to the specific requirements of the circuit breaker. The handle 1 is provided with a hole, the handle connecting rod 2 is U-shaped, and a cross section thereof is circular. The handle 1 and the moving contact bracket 6 are connected through the two ends of the handle connecting rod 2. Since the cross section of the handle connecting rod 2 is circular, a friction force between the handle connecting rod 2 and the bracket groove 4 on the moving contact bracket 6 is relatively small, so the wear may be reduced.

As shown in FIG. 1 to FIG. 2, a locking catch 8 arranged on a side surface of the moving contact bracket 6 is further included, the locking catch 8 is provided with a locking catch groove 16, the second end of the handle connecting rod 2 is placed in the locking catch groove 16 and the bracket groove 4, and while the handle connecting rod 2 is slid in the bracket groove 4 and the locking catch groove 16, the moving contact bracket 6 and the locking catch 8 may be driven to rotate.

The locking catch 8 is sheathed on the rotating shaft 5, and the locking catch 8 is connected with the moving contact bracket 6 by a locking catch torsion spring 18. A lower end of the locking catch 8 is provided with a bimetal pull rod 11, and one end, away from the locking catch 8, of the bimetal pull rod 11 is used to interfere with a bimetal strip of the circuit breaker.

Specifically, it should be noted that the first end of the handle connecting rod 2 is inserted into the handle 1, and the second end is inserted into the locking catch groove 16 and the bracket groove 4 sequentially, and the bracket groove 4 is arranged in an arc shape, so that it is achieved that the rotation of the handle 1 drives the moving contact bracket 6 to rotate. Because the moving contact bracket 6 and the locking catch 8 are connected by the locking catch torsion spring 18, and one side of the moving contact bracket 6 is pressed against the locking catch 8, the moving contact bracket 6 drives the locking catch 8 to rotate synchronously and compresses the locking catch torsion spring 18 while the moving contact bracket 6 is rotated. While the circuit breaker is closed in place, an end portion of the handle connecting rod 2 is locked in the bracket groove 4.

In the related technology, one end, installed on the locking catch 8, of the bimetal pull rod 11 passes through the locking catch 8, and this portion is a short leg of the bimetal pull rod 11. The short leg is prone to sagging in a using process, and handed to a copper braided wire so as to cause intermittent catch sliding. If there are burrs in the welding of the bimetal strip and the copper braided wire, it is also easy to interfere with the short leg of the bimetal pull rod 11, as to cause the catch sliding. Therefore, in this embodiment, a lower end of the locking catch 8 is provided with a fixing groove 17. One end of the fixing groove 17 is an opening, and the other end is a blind hole. An end portion of the bimetal pull rod 11 is fixed in the fixing groove 17 from the opening, so that the short leg of the bimetal pull rod 11 may not pass through the locking catch 8, thus in a moving process of the locking catch 8, the short leg of the bimetal pull rod 11 may not also be interfered, the mechanical life of the operating mechanism is improved to 10,000 times, and the intermittent catch sliding is eliminated.

Certainly, the other end of the fixing groove 17 may also not be a blind hole, but the length of a part, inserted into the fixing groove 17, of the bimetal pull rod 11 is less than the length of the fixing groove 17, so that the bimetal pull rod 11 may not be extended out of the fixing groove 17 and interfere with the copper braided wire.

The above are only preferred embodiments of the present application, and are not used to limit the present application. For those skilled in the art, the application may have various modifications and changes. Any modifications, equivalent replacements, improvements and the like made within the spirit and principle of the present application shall be included in a scope of protection of the present application.

What is claimed is:

1. An operating mechanism of a circuit breaker, comprising: a moving contact bracket, a moving contact assembly and a reset torsion spring; wherein, the moving contact bracket is provided with a rotating shaft, and the moving contact bracket is allowed to be rotated around the rotating shaft;

a first end of the reset torsion spring is arranged on a base of the circuit breaker, and a second end of the reset torsion spring is arranged on the moving contact assembly;

the moving contact assembly is rotatably arranged on the moving contact bracket, and the moving contact bracket is provided with a limiting portion, so that in a closing process of the circuit breaker, the moving contact assembly is pressed against the limiting portion and rotated synchronously with the moving contact bracket, and the reset torsion spring applies a force rotated towards a disconnection direction of the circuit breaker to the moving contact bracket; and while the circuit breaker is closed, the moving contact assembly and the moving contact bracket are rotated relatively, and the reset torsion spring applies a contact pressure to the moving contact assembly.

2. The operating mechanism of the circuit breaker as claimed in claim 1, wherein the moving contact assembly comprises a contact connector and a moving contact arranged on a lower end of the contact connector, wherein the contact connector is rotatably arranged on the moving contact bracket; and the second end of the reset torsion spring is arranged on the contact connector, and the second end of the reset torsion spring is located above a rotation axis of the contact connector.

3. The operating mechanism of the circuit breaker as claimed in claim 2, wherein the moving contact bracket is provided with a contact installing groove, the contact installing groove is provided with a rotating lug boss, the contact connector is arranged in the contact installing groove, the contact connector is provided with a slot, and the slot is locked on the rotating lug boss, so that the contact connector is allowed to be rotated around an axis of the rotating lug boss; and the limiting portion is a limiting lug boss arranged on the contact installing groove, and the contact connector is pressed against the limiting lug boss.

4. The operating mechanism of the circuit breaker as claimed in claim 3, wherein the moving contact bracket is provided with an annular installing groove, the annular installing groove is arranged coaxially with the rotating shaft, and the reset torsion spring is installed in the annular installing groove.

5. The operating mechanism of the circuit breaker as claimed in claim 4, wherein the moving contact bracket is provided with an upper limiting groove and a lower limiting groove, wherein the upper limiting groove and the lower limiting groove are communicated with the annular installing groove; and the first end and the second end of the reset torsion spring are respectively extended into the upper limiting groove and the lower limiting groove.

6. The operating mechanism of the circuit breaker as claimed in claim 2, wherein an upper end of the contact connector is provided with a catching groove, and the second end of the reset torsion spring is arranged in the catching groove.

7. The operating mechanism of the circuit breaker as claimed in claim 6, further comprising a handle, and a handle connecting rod, wherein the moving contact bracket is provided with a bracket groove, a first end of the handle connecting rod is connected to the handle, and a second end of the handle connecting rod is placed in the bracket groove; and while the handle connecting rod is slid in the bracket groove, the moving contact bracket is allowed to be driven to rotate to drive the moving contact assembly to operate.

8. The operating mechanism of the circuit breaker as claimed in claim 7, further comprising a locking catch arranged on a side surface of the moving contact bracket, wherein the locking catch is provided with a locking catch groove, the second end of the handle connecting rod is placed in the locking catch groove and the bracket groove, and while the handle connecting rod is slid in the bracket groove and the locking catch groove, the moving contact bracket and the locking catch are allowed to be driven to rotate.

9. The operating mechanism of the circuit breaker as claimed in claim 8, wherein the locking catch is assembled on the rotating shaft, and the locking catch is connected to the moving contact bracket by a locking catch torsion spring; and a lower end of the locking catch is provided with a bimetal pull rod, and an end of the bimetal pull rod contacts a bimetal strip of the circuit breaker, wherein the end of the bimetal pull rod is away from the locking catch.

10. The operating mechanism of the circuit breaker as claimed in claim 9, wherein the lower end of the locking catch is provided with a fixing groove, and an end portion of the bimetal pull rod is fixed in the fixing groove.

11. The operating mechanism of the circuit breaker as claimed in claim 3, wherein an upper end of the contact connector is provided with a catching groove, and the second end of the reset torsion spring is arranged in the catching groove.

12. The operating mechanism of the circuit breaker as claimed in claim 4, wherein an upper end of the contact connector is provided with a catching groove, and the second end of the reset torsion spring is arranged in the catching groove.

13. The operating mechanism of the circuit breaker as claimed in claim 5, wherein an upper end of the contact connector is provided with a catching groove, and the second end of the reset torsion spring is arranged in the catching groove.

14. The operating mechanism of the circuit breaker as claimed in claim 11, further comprising a handle, and a handle connecting rod, wherein the moving contact bracket is provided with a bracket groove, a first end of the handle connecting rod is connected to the handle, and a second end of the handle connecting rod is placed in the bracket groove; and while the handle connecting rod is slid in the bracket groove, the moving contact bracket is allowed to be driven to rotate to drive the moving contact assembly to operate.

15. The operating mechanism of the circuit breaker as claimed in claim 14, further comprising a locking catch arranged on a side surface of the moving contact bracket, wherein the locking catch is provided with a locking catch groove, the second end of the handle connecting rod is placed in the locking catch groove and the bracket groove, and while the handle connecting rod is slid in the bracket groove and the locking catch groove, the moving contact bracket and the locking catch are allowed to be driven to rotate.

16. The operating mechanism of the circuit breaker as claimed in claim 15, wherein the locking catch is assembled on the rotating shaft, and the locking catch is connected to the moving contact bracket by a locking catch torsion spring; and a lower end of the locking catch is provided with a bimetal pull rod, and an end of the bimetal pull rod contacts a bimetal strip of the circuit breaker, wherein the end of the bimetal pull rod is away from the locking catch.

17. The operating mechanism of the circuit breaker as claimed in claim 16, wherein the lower end of the locking catch is provided with a fixing groove, and an end portion of the bimetal pull rod is fixed in the fixing groove.

18. The operating mechanism of the circuit breaker as claimed in claim 12, further comprising a handle, and a handle connecting rod, wherein the moving contact bracket is provided with a bracket groove, a first end of the handle connecting rod is connected to the handle, and a second end of the handle connecting rod is placed in the bracket groove; and while the handle connecting rod is slid in the bracket groove, the moving contact bracket is allowed to be driven to rotate to drive the moving contact assembly to operate.

19. The operating mechanism of the circuit breaker as claimed in claim 18, further comprising a locking catch arranged on a side surface of the moving contact bracket, wherein the locking catch is provided with a locking catch groove, the second end of the handle connecting rod is placed in the locking catch groove and the bracket groove, and while the handle connecting rod is slid in the bracket groove and the locking catch groove, the moving contact bracket and the locking catch are allowed to be driven to rotate.

20. The operating mechanism of the circuit breaker as claimed in claim 19, wherein the locking catch is assembled on the rotating shaft, and the locking catch is connected to the moving contact bracket by a locking catch torsion spring; and a lower end of the locking catch is provided with a bimetal pull rod, and an end of the bimetal pull rod contacts a bimetal strip of the circuit breaker, wherein the end of the bimetal pull rod is away from the locking catch.

* * * * *